US006923159B2

(12) United States Patent
Sakumoto et al.

(10) Patent No.: US 6,923,159 B2
(45) Date of Patent: Aug. 2, 2005

(54) DIESEL ENGINE

(75) Inventors: Koji Sakumoto, Fujisawa (JP); Kazuyoshi Narita, Fujisawa (JP); Shigenobu Nagata, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 10/945,479

(22) Filed: Sep. 20, 2004

(65) Prior Publication Data

US 2005/0061298 A1 Mar. 24, 2005

(30) Foreign Application Priority Data

Sep. 22, 2003 (JP) ..... 2003-330286

(51) Int. Cl.[7] ..... F02M 37/20

(52) U.S. Cl. ..... 123/446; 123/497; 123/516; 123/179.17

(58) Field of Search ..... 123/446, 456, 123/497, 514, 516, 179.17

(56) References Cited

U.S. PATENT DOCUMENTS 4,984,554 A * 1/1991 Ariga et al. ..... 123/516
5,213,083 A * 5/1993 Glassey ..... 123/447
5,263,459 A * 11/1993 Talaski ..... 123/516
5,839,413 A * 11/1998 Krause et al. ..... 123/447
5,899,193 A * 5/1999 Betz II et al. ..... 123/516
6,817,343 B1 * 11/2004 Greco et al. ..... 123/497
2004/0237943 A1 * 12/2004 Krishnamoorthy et al. . 123/516

FOREIGN PATENT DOCUMENTS

| | | |
|---|---|---|
| JP | 02-188663 | 7/1990 |
| JP | 02-256869 | 10/1990 |
| JP | 04-043851 | 2/1992 |
| JP | 2568830 | 1/1998 |
| JP | 10-252599 | 9/1998 |
| JP | 11-257177 | 9/1999 |

* cited by examiner

*Primary Examiner*—Weilun Lo
(74) *Attorney, Agent, or Firm*—McCormick, Paulding & Huber LLP

(57) ABSTRACT

A diesel engine comprises a high-pressure pump (5) driven by an engine (E) to supply fuel in a fuel tank (2) to a common rail (3), an electric priming pump (13) provided in a fuel passage (15) extending from the fuel tank (2) to the high-pressure pump (5), and a control device (10) to control the electric priming pump (13). The control device (10) drives the electric priming pump (13) when the engine is started, if a state that the engine rotating speed (Ne) is higher than a predetermined first rotating speed (N1) and the common rail pressure (Cp) is lower than a predetermined first pressure (C1) continues for a period being equal to or more than a predetermined first period (T1). The burden on the operator is mitigated since necessity for the priming operation can be automatically judged.

10 Claims, 2 Drawing Sheets

DIESEL ENGINE

CROSS REFERENCE TO RELATED APPLICATION

Applicants hereby claim foreign priority benefits under U.S.C. §119 of Japanese Patent Application No. 2003-330286, filed on Sep. 22, 2003, and the content of which is herein incorporated by reference.

BACKGROUND OF THE INVENTION

1. Field of Invention

This invention relates to a diesel engine, and in particular, a diesel engine in which a priming operation required at the time of restarting of the engine after a lack of fuel, etc., can be performed.

2. Description of the Related Art

In case that air mixes into a fuel passage of a diesel engine caused by a lack of fuel or an exchange of a fuel filter, etc., a priming operation is required to remove the mixed air from the fuel passage.

In a conventional diesel engine, a manual priming pump is provided between a fuel tank and a high-pressure pump (injection pump) which supplies the fuel in the fuel tank to an injector, and the priming operation can be done by an operator such as a driver manually operating the priming pump. This type of priming pump is disclosed in, for example, Japanese laid-open Patent Application No. 10-252599.

However, since the operator needs to manually operate the priming pump in such a conventional diesel engine, burden on the operator is much. For example, a certain type of the priming pump may need to be moved up and down hundreds of times in order to remove the mixed air completely from the fuel passage. Moreover, since the operator is required to judge by his sense that the mixed air is completely removed from the fuel passage, this also increases the operator's burden.

Another type of diesel engine which has been proposed is that an electric pump is provided between the fuel tank and the high-pressure pump, and this electric pump automatically supplies the fuel in the fuel tank to the high-pressure pump to remove the mixed air. This type of diesel engine is disclosed in, for example, Japanese Patent Publication No. 7-103836.

However, in this diesel engine, neither judgment as to the necessity for the priming operation (judgment as to whether the air is mixed in the fuel passage) nor judgment as to a timing to stop the electric pump (judgment as to whether the mixed air is removed from the fuel passage) can be done automatically, and thus the priming operation does not come to be completely automated.

This is explained in more detail. In the diesel engine disclosed in the above Japanese Patent Publication No. 7-103836, since the above judgment cannot be done automatically, the electric priming pump is periodically driven. Consequently, the electric priming pump is driven also when the priming operation is not required. This decreases efficiency. Furthermore, in this diesel engine, driving and stopping of the electric priming pump is switched when the operator turns a switch to ON or OFF. That is, the above judgment is put into the operator's hand, and therefore the operator's burden still exists.

Thus, even if the electric priming pump is provided, a present state is that the priming operation is not completely automated. In the meantime, in the diesel engine equipped with a common rail type fuel injection system adoption of which is rapidly promoted in recent years, electronic control (automation) for the whole of the control system is promoted and it is also strongly desired to completely automate the priming operation.

SUMMARY OF THE INVENTION

It is an object of this invention to solve the above-mentioned problems and to provide a diesel engine in which a priming operation required at the time of restarting of the engine after a lack of fuel, etc., can be automatically performed.

In order to attain the above-mentioned object, this invention provides a diesel engine comprising a high-pressure pump driven by a crankshaft of the engine to supply fuel in a fuel tank to a common rail, an electric priming pump provided in a fuel passage extending from the fuel tank to the high-pressure pump, a control device to control the electric priming pump, engine rotating speed detection means to detect a rotating speed of the crankshaft of the engine, and common rail pressure detection means to detect a pressure within the common rail, wherein the control device drives the electric priming pump when the engine is started, if a state that the engine rotating speed detected by the engine rotating speed detection means is higher than a predetermined first rotating speed and the common rail pressure detected by the common rail pressure detection means is lower than a predetermined first pressure continues for a period being equal to or more than a predetermined first period.

Here, the predetermined first rotating speed may be set at a rotating speed at the time when the crankshaft is normally rotated by a starter motor.

The predetermined first pressure may be set at a value which is lower than a common rail pressure at the time of an idle operation of the engine.

The predetermined first period may be set at such a period within that the common rail pressure can sufficiently reach the predetermined first pressure in a usual state that air is not mixed in the fuel passage.

Moreover, the control device may stop the electric priming pump if the engine rotating speed detected by the engine rotating speed detection means becomes equal to or more than a predetermined second rotating speed after starting to drive the electric priming pump.

Here, the predetermined second rotating speed may be set at such a rotating speed that the engine operating state can be regarded as a complete explosion state.

Moreover, the control device may stop the electric priming pump if the common rail pressure detected by the common rail pressure detection means becomes equal to or more than a predetermined second pressure after starting to drive the electric priming pump.

Here, the predetermined second pressure may be set at such a pressure that mixed air is regarded as being sufficiently removed from the fuel passage.

Moreover, the control device may stop the electric priming pump if the electric priming pump is driven for a period which is equal to or more than a predetermined second period after starting to drive the electric priming pump.

Here, the predetermined second period may be set at such a period that the mixed air can be sufficiently removed from the fuel passage.

DESCRIPTION OF THE PREFERRED EMBODIMENTS

Preferred embodiments of this invention will now be described in detail with reference to the accompanying drawings.

Figure 1:
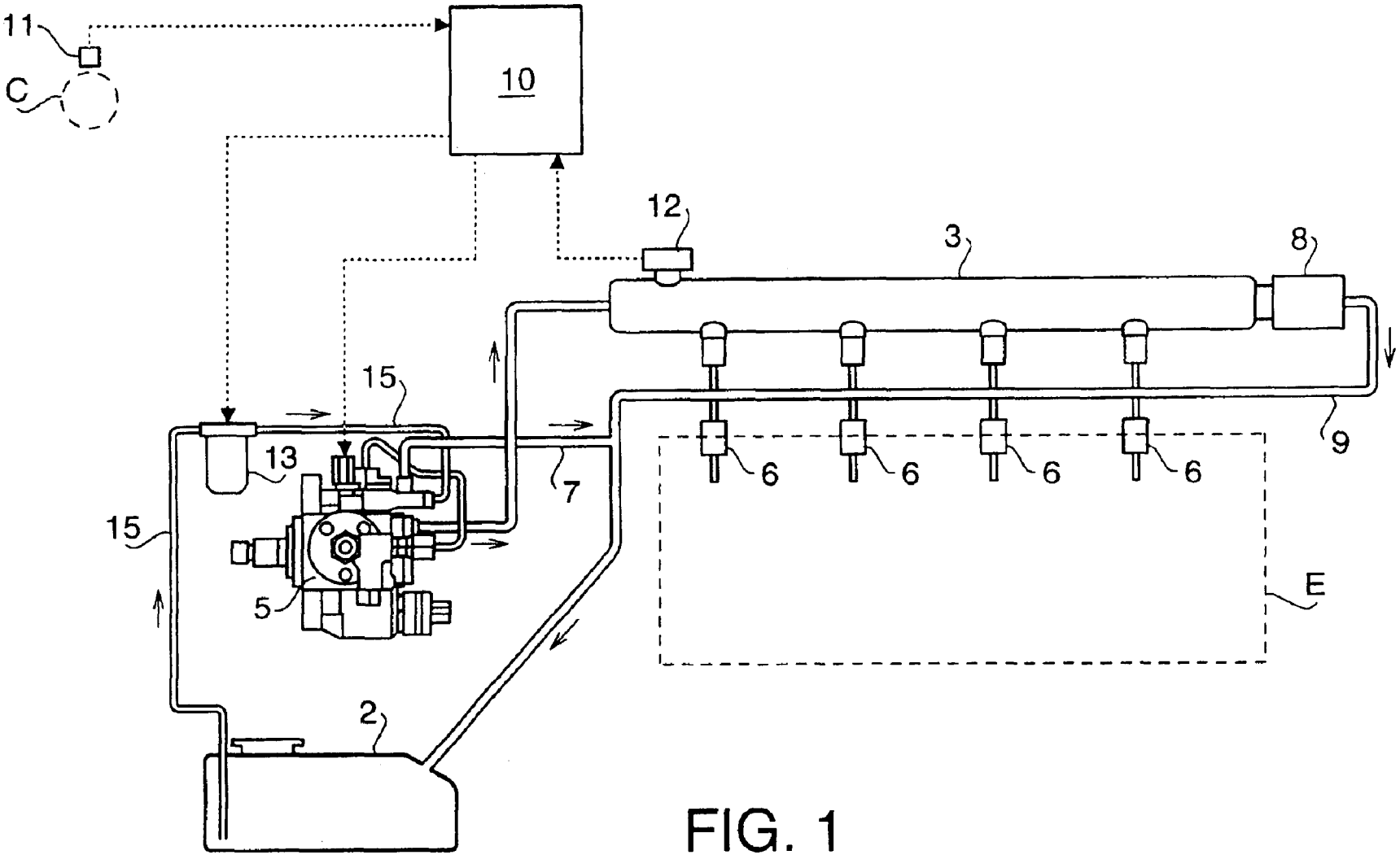
FIG. 1 is a schematic diagram of a diesel engine concerning one embodiment of this invention.

FIG. 1 is a schematic diagram of a diesel engine of this embodiment

The diesel engine of this embodiment is equipped with a common rail type fuel injection system, and comprises a fuel tank 2 and a high-pressure pump 5 (injection pump) to supply fuel in the fuel tank 2 to a common rail 3. The high-pressure pump 5 is coupled to a crankshaft C of the engine E via a gear train, etc., and is driven by the crankshaft C.

An injector 6 is provided in each cylinder of the engine E, and each injector 6 is respectively connected to a common rail 3.

The fuel in the fuel tank 2 is sucked by the high-pressure pump 5, and then is delivered to the common rail 3 to be accumulated therein. The high-pressure fuel in the common rail 3 is supplied to each injector 6.

An overflow passage 7 is connected to the high-pressure pump 5 to return the surplus fuel to the fuel tank 2, and another overflow passage 9 is connected to the common rail 3 to return the surplus fuel discharged from a relief valve 8 to the fuel tank 2.

A control device 10 (referred to as ECU (Electronic Control Unit) hereinafter) is provided to electronically control the diesel engine. Various detection means are connected to the ECU 10, and the ECU 10 controls each controlled system based on detection values of these detection means.

Specifically, the ECU 10 is connected with, for example, the engine rotating speed sensor (engine rotating speed detection means) 11 to detect a rotating speed of the crankshaft C of the engine E, and a common rail pressure sensor (common rail pressure detection means) 12 to detect a pressure within the common rail 3. The ECU 10 adjusts the amount of fuel flowing into the high-pressure pump 5 based on detection values of, for example, these sensors 11 and 12 to change the amount of delivery from the pump 5 to control the common rail pressure. Moreover, the ECU 10 carries out an opening and closing control for the injector 6 based on detection values of, for example, the sensors 11 and 12 to control a fuel injection quantity and a fuel injection timing, etc.

Furthermore, the diesel engine of this embodiment comprises an electric priming pump 13 to automatically perform a priming operation required at the time of, for example, restarting of the engine after a lack of fuel. The electric priming pump 13 is provided in the middle of the fuel intake passage 15 which extends from the fuel tank 2 to the high-pressure pump 5. The electric priming pump 13 is controlled by the ECU 10.

The electric priming pump 13 is usually stopped (not driven), and is driven if it is judged that the priming operation is required by a control at the time of starting of the engine described after. If the electric priming pump 13 is driven, the fuel in the fuel tank 2 is delivered to the high-pressure pump 5, and the mixed air in the fuel intake passage 15 is compulsorily discharged through the overflow passages 7 and 9, etc., into the fuel tank 2. Therefore, the air is removed from the fuel passage.

Figure 2:
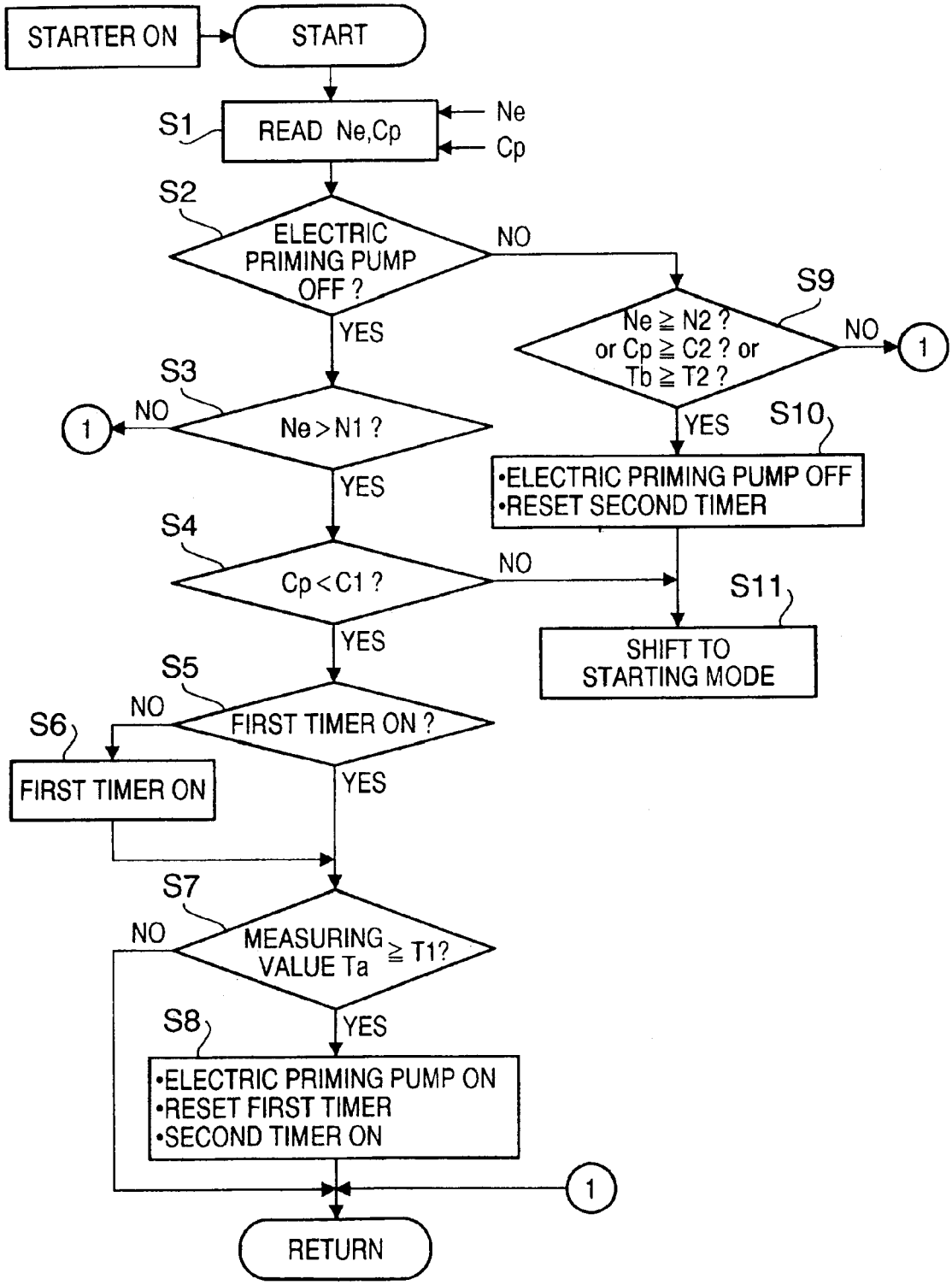
FIG. 2 is a flow chart relating to a control which is performed by an ECU of the diesel engine of FIG. 1 when the engine is started.

A control at the time of starting of the engine in the diesel engine of this embodiment is now described using the flow chart of FIG. 2. This control is performed by the ECU 10.

In a conventional diesel engine, if a starter is turned ON, a control mode referred to as a starting mode is performed, and thereafter the control mode shifts to a normal mode (a running mode). The starting mode is performed from a time that the starter is turned ON until a time that combustion is fully performed in the engine and the engine can rotate without help by the starter motor. Specifically, more fuel is injected than the normal mode in the starting mode, and if the engine rotating speed reaches a predetermined value (for example, 900 rpm), the control mode shifts to the normal mode.

In the diesel engine of this embodiment, a priming operation judging mode shown in FIG. 2 is performed in advance of the starting mode when the starter is turned ON.

Firstly, this control starts when the starter is turned ON, and in step S1, the present engine rotating speed Ne detected by the engine rotating speed sensor 11 and the present common rail pressure Cp detected by the common rail pressure sensor 12 are read.

Next, the control proceeds to step S2 in which it is judged whether the electric priming pump 13 is stopped (OFF). If the starter is turned ON and this control is performed at the first time, the electric priming pump 13 is usually OFF.

If the electric priming pump 13 is OFF, the control proceeds to step S3 in which it is judged whether the engine rotating speed Ne read in step S1 is higher than the predetermined first rotating speed N1 inputted into the ECU 10 beforehand. The predetermined first rotating speed N1 is a value for judging whether the crankshaft C of the engine E is rotated normally by the starter motor. In other words, it is a value for judging whether the high-pressure pump 5 is driven normally by the crankshaft C of the engine E. The predetermined first rotating speed N1 is set at 60 rpm in this embodiment. If the engine rotating speed Ne is equal to or less than the predetermined first rotating speed N1, the control returns to step S1, and the above-mentioned control is repeatedly performed.

In step S3, if it is judged that the engine rotating speed Ne is higher than the predetermined first rotating speed N1 (i.e., Ne>N1), then the control proceeds to step 4 where it is judged whether the common rail pressure Cp read at step S1 is lower than a predetermined first pressure C1 inputted into the ECU 10 in advance. The predetermined first pressure C1 is set at a value which is lower than the minimum common rail pressure at the time of the normal mode or the normal operation of the engine (for example, lower than a common rail pressure at the time of idle operation). In this embodiment, the predetermined first pressure C1 is 6 MPa.

In step S4, if it is judged that the common rail pressure Cp is lower than the predetermined first pressure C1 (Cp<C1), the control proceeds to step S5 in which it is judged whether a first timer built in the ECU 10 is turned ON. When the starter is turned ON and this control is performed at the first time, the first timer is usually OFF.

If the first timer is OFF, the control proceeds to step S6 in which the first timer is turned ON and a time measurement is started.

Next, the control proceeds to step S7 in which it is judged whether the measuring value Ta of the first timer is equal to or more than a predetermined first period T1 inputted into the ECU 10 in advance. While the measuring value Ta of the first timer is less than the predetermined first period T1, the control returns to step S1 and the control mentioned above is repeatedly performed.

If it is judged that the measuring value Ta of the first timer is equal to or more than the predetermined first period T1, the control proceeds to step S8 in which the electric priming pump 13 is turned ON (or driven). That is, the priming operation is started.

Here, the predetermined first period T1 is set at such a period within that the common rail pressure can sufficiently reach the above-mentioned predetermined first pressure C1 in a usual state that the air is not mixed in the fuel passage. In this embodiment, the predetermined first period T1 is 4 sec.

In case that the air is mixed in the fuel passage at the time of, for example, restarting of the engine after the lack of fuel, the fuel is left out of the fuel passage and the common rail pressure does not increase even if the high-pressure pump 5 is driven. Accordingly, utilizing this phenomenon, necessity for the priming operation is automatically judged in the diesel engine of this embodiment. That is, the priming operation is judged to be necessary and the electric priming pump 13 is driven, if the common rail pressure does not reach the predetermined value C1 even if the high-pressure pump 5 is driven normally and the period T1 goes by, although this period T1 can be originally regarded as such period that the common rail pressure reaches the predetermined value C1. In other words, the electric priming pump 13 is driven when the engine E is started, if a state that the engine rotating speed Ne detected by the engine rotating speed sensor 11 is more than the predetermined first rotating speed N1 (it is judged in step S3) and that the common rail pressure Cp detected by the common rail pressure sensor 12 is lower than the predetermined first pressure C1 (it is judged in step S4) continues for a period being equal to or more than the predetermined first period T (it is judged in step S7). On the contrary, if the common rail pressure reaches the predetermined value C1 before the predetermined period T1 passes by (i.e., judgment is No in step S4), then it is judged that the priming operation is unnecessary, and the control proceeds to step S11 to shift to the starting mode mentioned above.

In step S8, the electric priming pump 13 is turned ON, and simultaneously, the first timer is reset and the second timer is turned ON. In this embodiment the first timer is substantially the same as the second timer. Therefore in step S8, time measurement is resumed immediately after the timer is reset. The second timer is applied for measuring the driving period of the electric priming pump 13.

The control returns to step S1 again after step S8. In this case, since the electric priming pump 13 is already ON, No is judged in step S2 and it goes to step S9.

In step S9, it is judged whether (i) the engine rotating speed Ne read in step S1 is equal to or more than a predetermined second rotating speed N2 inputted into the ECU 10 in advance, (ii) the common rail pressure Cp read in step S1 is equal to or more than a predetermined second pressure C2 inputted into the ECU 10 in advance, and (iii) the measuring value Tb of the second timer is equal to or more than a predetermined second period T2 inputted into the ECU 10 in advance.

Each of the conditions (i), (ii) and (iii) of this step S9 is a condition for judging the propriety of finishing the priming operation (i.e., for judging whether the mixed air is removed from the fuel passage).

Regarding the predetermined second rotating speed N2, it is set at such a value that the engine operating state can be regarded as a complete explosion state. The engine operating state being the complete explosion state means that sufficient quantity of fuel is supplied to the common rail 3 and the injector 6, and therefore that it is possible to judge that the mixed air is removed from the fuel passage. In this embodiment, the predetermined second rotating speed N2 is 900 rpm, and is the same as the rotating speed at the time when the control mode shifts from the starting mode to the normal mode as mentioned above. Alternatively, of course, the predetermined second rotating speed N2 may be set at a different value from the above value used when the control mode shifts from the starting mode to the normal mode. The predetermined second rotating speed N2 may be set at a higher value than the above-mentioned predetermined first rotating speed N1.

Next, regarding the predetermined second pressure C2, it is set at such a value that the mixed air is regarded as being sufficiently removed from the fuel passage. If the mixed air in the fuel passage is removed by the priming operation, the fuel will be supplied to the common rail 3 and the common rail pressure will go up. When this going up of the common rail pressure is detected, it is judged that the priming operation is unnecessary. In this embodiment, the predetermined second pressure C2 is 6 MPa, and is set at the same as the predetermined first pressure C1. Of course, the predetermined second pressure C2 may be set at a different value from the predetermined first pressure C1. Usually, the predetermined second pressure C2 is set at a value being equal to or more than the predetermined first pressure C1.

Next, regarding the predetermined second period T2, it is set at such a value within that the mixed air in the fuel passage is regarded as being sufficiently removed by the priming operation with the electric priming pump 13. That is, the predetermined second period T2 is set at such a value that the mixed air is nearly completely removed by driving the electric priming pump 13 for the period T2, taking capacity of the fuel passage, performance of the electric priming pump 13, etc., into consideration. In this embodiment, the predetermined second period T2 is 300 sec.

If all three conditions (Ne>=N2, Cp>=C2, Tb>=T2) are not satisfied in step S9, the control returns to step S1. That is, the electric priming pump 13 continues to be driven when all of three conditions are denied.

On the other hand, in step S9, when at least one of three conditions is satisfied, the control proceeds to step S10 in which the electric priming pump 13 is stopped (OFF) and the second timer is reset. That is, the priming operation is completed. Then, the control goes to step S11 to shift to the starting mode.

Thus, according to the diesel engine of this embodiment, the priming operation is completely automated, since the ECU 10 automatically performs judgment as to necessity for the priming operation and a stop timing for the electric pump. That is, the priming operation can be done without giving the operator any burden.

This invention is not limited to the above-mentioned embodiment, but various modifications can be considered.

For instance, values of the above-mentioned predetermined values N1, N2, C1, C2, T1, and T2 are shown as an example, and do not limit this invention.

Moreover, the control was described as going to steps S10 and S11 to shift to the starting mode if at least one of three conditions (Ne>=N2, Cp>=C2, Tb>=T2) of step S9 is satisfied in the above embodiment. However, in the case that the predetermined second rotating speed N2 of step S9 is the same as the rotating speed for shifting from the starting mode to the normal mode like the above-mentioned embodiment, the control may shift to the normal mode via step S10 if the judgment condition as to the engine rotating speed is satisfied in step S9 (i.e., Ne>=N2).

Moreover, in step S9, it is not always necessary to prepare all three judgment conditions as mentioned above, but any one or two may be selectively applied.

What is claimed is:

1. A diesel engine comprising:

a high-pressure pump driven by a crankshaft of the engine to supply fuel in a fuel tank to a common rail;

an electric priming pump provided in a fuel passage extending from the fuel tank to the high-pressure pump;

a control device to control the electric priming pump;

engine rotating speed detection means to detect a rotating speed of the crankshaft of the engine; and common rail pressure detection means to detect a pressure within the common rail, wherein the control device drives the electric priming pump when the engine is started, if a state that the engine rotating speed detected by the engine rotating speed detection means is higher than a predetermined first rotating speed and the common rail pressure detected by the common rail pressure detection means is lower than a predetermined first pressure continues for a period being equal to or more than a predetermined first period.

2. The diesel engine as defined in claim 1, wherein the predetermined first rotating speed is set at a rotating speed at the time when the crankshaft is rotated normally by a starter motor.

3. The diesel engine as defined in claim 1, wherein the predetermined first pressure is set at a value which is lower than a common rail pressure at the time of an idle operation of the engine.

4. The diesel engine as defined in claim 1, wherein the predetermined first period is set at such a period within that the common rail pressure can sufficiently reach the predetermined first pressure in a usual state that air is not mixed in the fuel passage.

5. The diesel engine as defined in claim 1, wherein the control device stops the electric priming pump if the engine rotating speed detected by the engine rotating speed detection means becomes equal to or more than a predetermined second rotating speed after starting to drive the electric priming pump.

6. The diesel engine as defined in claim 5, wherein the predetermined second rotating speed is set at such a rotating speed that the engine operating state can be regarded as a complete explosion state.

7. The diesel engine as defined in claim 1, wherein the control device stops the electric priming pump if the common rail pressure detected by the common rail pressure detection means becomes equal to or more than a predetermined second pressure after starting to drive the electric priming pump.

8. The diesel engine as defined in claim 7, wherein the predetermined second pressure is set at such a pressure that mixed air is regarded as being sufficiently removed from the fuel passage.

9. The diesel engine as defined in claim 1, wherein the control device stops the electric priming pump if the electric priming pump is driven for a period which is equal to or more than a predetermined second period after starting to drive the electric priming pump.

10. The diesel engine as defined in claim 9, wherein the predetermined second period is set at such a period that mixed air can be sufficiently removed from the fuel passage.

* * * * *